United States Patent [19]

Grace

[11] 4,187,782

[45] Feb. 12, 1980

[54] SHAPED CHARGE DEVICE

[75] Inventor: Fred I. Grace, York, Pa.

[73] Assignee: The United States of America as represented by the Secretary of the Army, Washington, D.C.

[21] Appl. No.: 900,225

[22] Filed: Apr. 26, 1978

[51] Int. Cl.[2] ..... F42B 13/10

[52] U.S. Cl. ..... 102/56 SC

[58] Field of Search ..... 89/8; 102/24 HC, 56 SC, 102/DIG. 2

[56] References Cited

U.S. PATENT DOCUMENTS

| | | | |
|---|---|---|---|
| 3,145,656 | 8/1964 | Cook et al. | 102/24 HC |
| 3,224,368 | 12/1965 | House | 102/24 HC |
| 3,254,564 | 6/1966 | Morley et al. | 89/8 |
| 4,004,515 | 1/1977 | Mallory | 102/24 HC |

FOREIGN PATENT DOCUMENTS

| | | | |
|---|---|---|---|
| 1024862 | 2/1958 | Fed. Rep. of Germany | 102/24 HC |
| 1109580 | 6/1961 | Fed. Rep. of Germany | 102/24 HC |

*Primary Examiner*—Verlin R. Pendegrass

*Attorney, Agent, or Firm*—Nathan Edelberg; Robert P. Gibson; Max Yarmovsky

[57] ABSTRACT

A shaped charge device for a projectile has a nested structure which provides a relatively long lethal jet. The device employs a body of explosive material having a hollow formed therein. A sheath formed of ductile material is mounted within that hollow. Coaxially mounted within the sheath is an elongated casing. The casing which is formed of ductile material is spaced from the sheath. A layer of material is interposed between the sheath and casing. Upon detonation of the body of explosive material, the casing violently collapses to form a lethal jet.

8 Claims, 4 Drawing Figures

SHAPED CHARGE DEVICE

BACKGROUND OF THE INVENTION

The invention described herein may be manufactured, used and licensed by or for the Government for Governmental purposes without the payment to me of any royalties thereon.

The present invention relates to shaped charge devices and in particular to projectile warheads capable of forming a lethal jet.

It has been found that a strong armor piercing capability is obtained from a main explosive charge having a conical cavity lined with a ductile material such as metal. Upon detonation a pressure wave propagates across the conical liner causing it to collapse upon its axis. This collapse, commencing at the conical vertex, proceeds with intensity sufficient to form portions of the conical liner into a high velocity jet. Such a jet, which can be significantly longer than the liner itself, pierces metal armor to an extent related to the jet length. This jet length and thus, the armor piercing capability of the warhead depends on the size of the conical liner. The liner size is often limited by a requirement that it must fit within a shell of a certain diameter. Also, conventional liners are found to have poor jet formation characteristics for conical angles less than 40°. If the base diameter and the conical angle of the liner are so constrained, a large class of smaller weapons (such as fixed diameter gun systems) may have limited effectiveness against relatively thick armor.

The present invention provides a shaped charge device which may be confined within a relatively small diameter shell but still provide a lethal jet similar to that provided by a larger diameter shell. To this end a nested structure is provided which collapses in a manner simulating the collapse of a larger conical liner. This collapse propagates across the nested structure causing sharp bending which deforms the structure in a manner facilitating jet formation. Since the bending within the nested structure is sharper than that occurring within a simple conical liner, the present invention can employ a liner having a relatively low conical angle or a cylindrical liner.

SUMMARY OF THE INVENTION

In accordance with the illustrative embodiments demonstrating features and advantages of the present invention, there is provided a shaped charge device for a projectile. The shaped charge device includes a body of explosive material having a hollow formed therein. Also included is a sheath formed of ductile material mounted within the hollow. Coaxially mounted within and spaced from the sheath is an elongated casing formed of ductile material. Interposed between said sheath and said casing is a layer of material.

BRIEF DESCRIPTION OF THE DRAWINGS

The above brief description as well as further objects, features and advantages of the present invention will be more fully appreciated by reference to the following detailed description of presently preferred but nonetheless illustrative embodiments in accordance with the present invention when taken in conjunction with the accompanying drawings wherein.

DETAILED DESCRIPTION OF THE PREFERRED EMBODIMENTS

Figure 1:
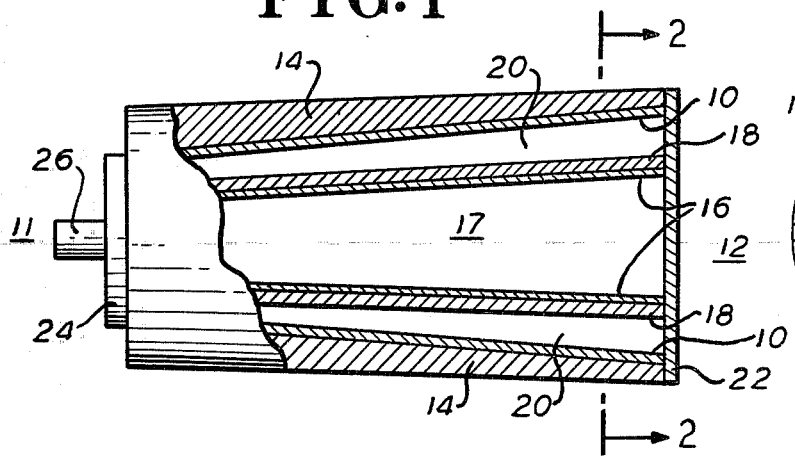
FIG. 1 is an elevational view, partly in section, of a shaped charge device of the instant invention.

Referring now specifically to the drawings, in FIG. 1 a sheath is shown therein as a band of metal 10 having a frustroconical shape. The walls of sheath 10 make an angle with respect to its axis of 9.5°. While sheath 10 is shown with walls of uniform thickness, as explained hereinafter in some embodiments the walls of sheath 10 may be thicker for portions near forward end 12. Also sheath 10 may have a cylindrical shape or a curved bell shape in other embodiments. Encircling sheath 10 is a body of explosive material 14 shown herein as an essentially cylindrical main charge (outside slightly tapered) having a tapered axial bore. Other shapes may be employed for charge 14 such as a cup or a bellshaped structure. As explained hereinafter, the fact that the walls of charge 14 are thinner near the forward end 12 provides an advantageous variation in the metal to explosive ratio.

Nested within sheath 10 is casing 16 shown herein as a frustro-conical band encompassing an empty space 17. The walls of casing 16 make an angle of 6.5° with respect to its axis. Casing 16 may take other forms such as a hollow cylinder, a cone, a bellshaped member, etc. A layer of material 18 employed in this embodiment is a uniform jacket of explosive material encompassing the outer surface of casing 16. The sheath 10, casing 16 and layer 18 are arranged to provide a diverging interspace 20. Interspace 20 is such that the radial spacing between sheath 10 and casing 16 is greater near the forward end 12. Suitably attached to the forward end 12 of sheath 10 and casing 16 is end cap 22 which supports and maintains the radial spacing of sheath 10 and casing 16. A complimentary end cap 24 is suitably attached to the opposite ends of casing 16 and sheath 10 to maintain their concentricity.

Coupled to an end of main charge 14 and explosive layer 18 is a detonating means 26. Detonating means 26 may take any one of several well-known forms and in this embodiment it employs an electrically detonatable fuse. In this embodiment, main charge 14 and layer 18 are simultaneously detonated, although their detonation may be sequenced in other embodiments. The entire assembly of FIG. 1 is mounted in the warhead of projectile (not shown) with forward end 12 in front.

Figure 2:
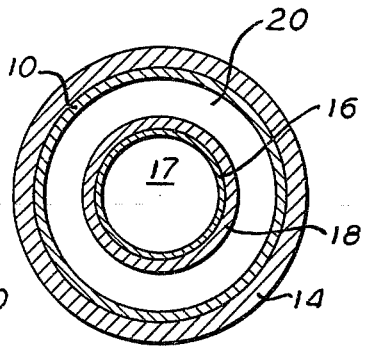
FIG. 2 is a cross-sectional view of the shaped charge device along lines 2—2 of FIG. 1.

Referring to FIG. 2 a sectional view along lines 2—2 of FIG. 1 shows a group of concentric annuli. Casing 16 is shown having a uniform wall thickness and being in contact with a uniform layer of explosive material 18. Also the radial dimension of interspace 20 is shown as being axially symmetric. Sheath 10 is shown having uniformly thick walls surrounded by a uniform explosive jacket, that is, by main charge 14. It is appreciated that while the wall thickness of charge 14 is uniform in this view, its thickness is different for positions axially displaced from the one shown in this FIG. 2.

Figure 3:
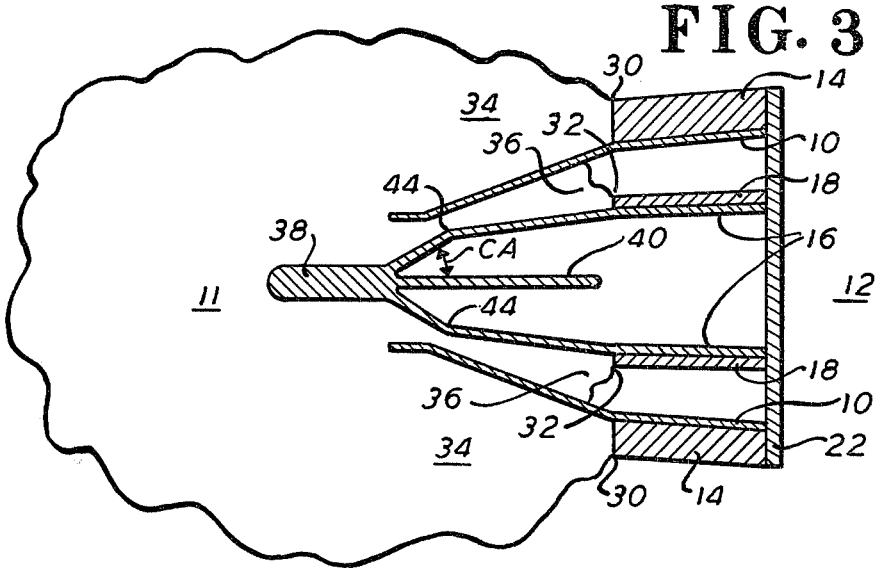
FIG. 3 is an elevational view in section of the shaped charge device of FIG. 1 showing progressive deformation caused by detonation.

FIG. 3 illustrates the deformation occurring a short time after detonating means 26 has been triggered. Detonating means 26 ignites adjacent ends of main charge 14 and layer 18. For the explosives employed herein the explosion propagates from the point of ignition in a wave traveling in the order of 8 kilometers per second, although other rates may be employed. The wavefronts 30 and 32 are shown traveling from aft end 11 toward forward end 12, leaving behind high pressure gasses 34 and 36, respectively, which are the products of explosion. This violent process drives a portion of sheath 10 and casing 16 radially inward. For purpose of analysis both sheath 10 and casing 16 may be viewed as being composed of a large number of small elements whose initial speed depends upon the mass ratio of that element to the explosive charge disposed thereupon. Since sheath 10 has disposed upon it a thicker wall of explosives than that upon casing 16 the initial inward velocity of sheath 10 exceeds the initial inward velocity of casing 16. As a result the sheath 10 outpaces casing 16 and collides therewith. The nature of this collision is such that while sheath 10 does not contact casing 16, gas 36 is so compressed that energy is imparted to casing 16 to increase its inward velocity. The collapse progresses with such intensity that the casing 16 is formed into a slug portion 38 and a jet portion 40. The jet portion 40 has liquid-like properties and it flows toward the forward end 12 in a thin column at high velocity. This high velocity jet of metal has the ability to pierce metal armor by deforming and pushing it aside. Since each element of jet portion 40 which impinges upon such armor bores into the armor an incremental amount, penetrating ability is a function of the length of jet portion 40 and thus the length of casing 16.

The aforementioned collision between sheath 10 and casing 16 occurs after detonation wave 32 has passed. This collision may itself be considered a secondary implosion wave which propagates across casing 16. In FIG. 3 this secondary implosion wave has reached position 44. It may be observed that the casing markedly bends around the secondary implosion wavefront's position 44. If the angular displacement due to such bending around position 44 (referring to the acute angle which would increase as bending increases) is designated DI then approximately:

$$CA = DI + LA$$

where CA is the conical collapse angle so identified in FIG. 3 and LA is the initial angle the walls of casing 16 made with respect to its axis. To provide a satisfactory jet, angle CA ought to be about 35° or greater. Conventional shaped charge devices having a single conical liner provide this relatively large collapse angle by employing a liner already having a relatively large conical angle before detonation. Such conventional conical liners have an initial conical angle with respect to axis of about 21° (42° included angle) so that if the main charge bends this liner an additional 14°, this liner collapses upon its axis at the required 35° angle. As will become clear, the casing 16 disclosed herein bends more sharply so that it can be constructed with a low conical angle or as a cylinder (zero conical angle).

The bending angle about the wavefront position 44 is a function of the propagation velocity of this wavefront. The bending angle may be estimated from the following well-understood formula which is applicable to implosions:

$$2 \arcsin [VS/2(VP)]$$

In that formula VS in the inward velocity of the portion being bent and VP is the propagation velocity of the implosion wavefront. In terms of the bending angle about position 44, it can be appreciated that this bending angle is an inverse function of the propagation velocity of the wavefront at position 44. Thus low propagation velocity tends to cause high bend angles. As will become clear hereinafter the arrangement of FIG. 3 provides a wavefront at position 44 which is relatively slow in comparison to the wavefronts 30 and 32, which facilitates sharp bending.

The secondary implosion wavefront at position 44 results from sheath 10 intercepting and colliding with casing 16. Since these two travel at different velocities, for the reasons previously given, their closing velocity is equal to their difference in velocity. If this closing velocity for a first position on sheath 10 is designated CV1 and if the closing velocity for a second position on sheath 10 which is displaced toward forward end 12 a unit distance, is designated CV2, then:

$$DT = T1 + (R2/CV2) - (R1/CV1)$$

where T1 is the time required for wavefront 30 to traverse that unit distance, where DT is the time required for the secondary implosion wavefront to traverse that unit distance and where R1 and R2 are the radial spacings prior to detonation for the sheath 10 and casing 16 for this first and second position, respectively. Since interspace 20 diverges toward forward end 12 radial dimension R2 exceeds R1. Also since the explosive to metal ratio varies along sheath 10, closing velocity CV1 exceeds velocity CV2. In one embodiment this velocity gradient was about 2.8% per centimeter. As is apparent from the foregoing the transit time for the secondary implosion wavefront (located at position 44 in FIG. 3) to traverse a unit distance is greater than the transit time for wavefront 30 along the same distance. In effect, the diverging interspace 20 and the variation in explosive to metal ratio causes an ever increasing lag between wavefront 30 and the secondary implosion wavefront at position 44. If the angle at which interspace 20 diverges is about 3° and the propagation velocity of wavefront 30 is about 8 kilometers per second then with closing velocities in the range of 1.02 to 1.05 kilometers per second, the propagation velocity of the secondary implosion wavefront at position 44 is about 4 kilometers per second. This means the secondary implosion wavefront travels at approximately half the velocity of detonation wavefront 30 or 32. Applying this relatively slow propagation velocity to the previously mentioned formula for bending angle, a bending angle of about 29° about position 44 is calculated for an inward velocity VS for casing 16 of 2 kilometers per second. This 29° angle of bend is about twice that expected for a conventional conical liner. Accordingly, the angle CA at which casing 16 collapses upon its axis is about 35.5°, which is the sum of the aforementioned 29° bend angle at position 44 plus the 6.5° angle which the walls of casing 16 make with respect to its axis prior to detonation. Therefore the collapse angle of casing 16 is about the same as the collapse angle of a conventional conical liner. However since casing 16 has a relatively small conical angle, it may be comparatively long and still fit within a small diameter. Therefore a small diameter gun can provide a relatively long lethal jet.

While the foregoing described a specific angular arrangement, it is appreciated that the angles discussed may be varied. In some embodiments it may be desirable to construct a cylindrical casing which is concentric within a cylindrical sheath. While such an arrangement may tend to reduce some of the jet properties, it will provide performance superior to that attainable from a conventional shaped charge device.

Figure 4:
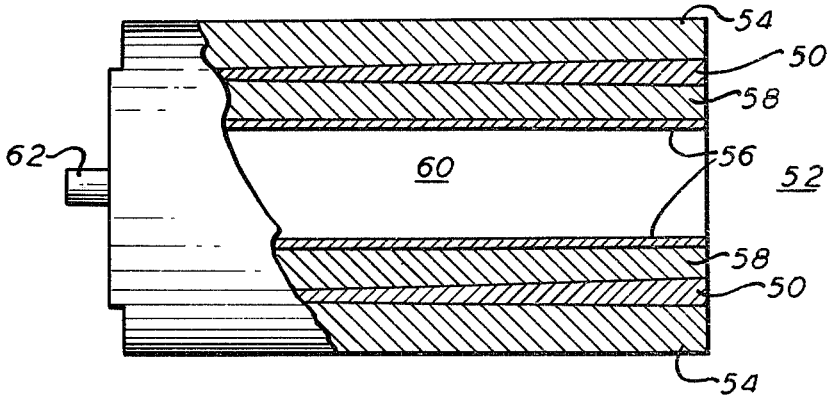
FIG. 4 is an elevational view, partly in section of a second embodiment of a shaped charge device of the instant invention.

Referring to FIG. 4, an embodiment alternative to that of FIGS. 1-3 is shown. A sheath is shown herein as a hollow cylinder 50 whose walls progressively thicken toward the forward end 52. The body of explosive material employed herein is main charge 54 which has a cylindrical outer surface and which encircles sheath 50. The casing is shown herein as hollow cylindrical casing 56 which has a uniform wall thickness throughout. Material 58 is a compressible foam spacer which occupies the interspace between sheath 50 and casing 56. The interior 60 of casing 56 is empty. Detonating means 62 is a device which detonates the adjacent end of main charge 54. The cross sections of the members 50, 54, 56 and 58 are concentric circular annuli similar to those shown in FIG. 2.

The operation of the device of FIG. 4 is similar to that previously given in connection with FIG. 3. Whereas the diverging interspace 20 of FIG. 3 resulted in an ever-increasing transit time for the sheath to casing collision, the fact that the wall thickness of sheath 50 of FIG. 4 is non-uniform provides a similar result. Because the wall thickness of sheath 50 is greater near end 52, elements of sheath 50 near this end travel more slowly. As a result there is an ever-increasing lag between a detonation wavefront traveling through main charge 54 and a secondary implosion wavefront caused by a collision between sheath 50 and casing 56.

It is appreciated that compressible spacer 58 maintains the spacing and concentricity of sheath 50 and casing 60. Being compressible, material 58 allows sheath 50 to travel toward casing 56.

The foregoing embodiments may be varied dimensionally to provide the specific jet length and velocity required. The materials may also be varied and many ductile materials may be employed for the casing or the sheath. It is expected that embodiments will employ copper, aluminum, nickel or iron depending upon the desired penetrating ability, weight etc. Obviously many other modifications and variations of the present invention are possible in light of the above teachings. It is therefore to be understood that within the scope of the appended claims, the invention may be practiced otherwise than as specifically described.

I claim:

1. A shaped charge device for a projectile comprising:

a flared sheath formed of ductile material;

a body of explosive material having a hollow formed therein for operatively holding said sheath which includes;

an annular cross section disposed upon the surface of said sheath, wherein said sheath has a forward and an aft end, said body of explosive material having a thickness which decreases from said aft to said forward end;

an elongated casing formed of ductile material coaxially mounted within and spaced from said sheath, said sheath providing a diverging interspace between said casing and said sheath; and a layer of material interposed between said sheath and said casing which includes;

explosive material disposed upon said casing and spaced from said sheath;

a compressible spacer mounted between said sheath and said casing.

2. A shaped charge device according to claim 1 wherein said sheath and said casing each have a hollow conical shape, the conical angle of said sheath exceeding that of said casing, said sheath and said casing being coaxial and tapering in the same direction.

3. A shaped charge device according to claim 2 wherein said sheath and said casing each comprise a band of uniform thickness having a frustro-conical shape.

4. A shaped charge device according to claim 3 wherein said body of explosive material comprises a cylinder having a tapered axial bore, said body of explosive material being disposed upon the outer surface of said sheath.

5. A shaped charge device according to claim 4 further comprising:

detonating means for detonating said body of explosive material and said layer at adjacent ends whereby detonation propagates toward their respective opposite ends.

6. A shaped charge device according to claim 5 wherein said detonating means sequentially detonates said layer and said body of explosive material.

7. A shaped charge device according to claim 1 wherein said sheath has a flared portion having walls of a varying thickness, said walls being thicker at positions nearer the diverging end of said flared portion, whereby the explosive to structure ratio is axially variable.

8. A shaped charge device according to claim 3 further comprising:

a first cap attached to an end of said sheath and an end of said casing; and a second cap attached to the opposite end of said sheath and the opposite end of said casing, whereby the radial spacing of said sheath and said casing is maintained.

* * * * *